United States Patent [19]

Condon

[11] Patent Number: 4,732,423

[45] Date of Patent: Mar. 22, 1988

[54] INVALID'S CHAIR CONSTRUCTION

[75] Inventor: James R. Condon, Hampden, Mass.

[73] Assignee: Bio-Architectural Design, Inc., Springfield, Mass.

[21] Appl. No.: 923,586

[22] Filed: Oct. 27, 1986

[51] Int. Cl.[4] ..... A47C 1/032; A47C 7/36

[52] U.S. Cl. ..... 297/284; 297/301; 297/328; 297/353; 297/DIG. 4

[58] Field of Search ..... 297/284, 300, 301, 313, 297/328, 353, 459, DIG. 4; 403/DIG. 9

[56] References Cited

U.S. PATENT DOCUMENTS

| | | | |
|---|---|---|---|
| 527,056 | 10/1894 | Gilson | 297/408 X |
| 1,542,508 | 6/1925 | Koenigkramer | 297/328 X |
| 3,059,971 | 10/1962 | Becker | 297/353 |
| 3,279,850 | 10/1966 | Saemann et al. | 297/353 X |
| 3,284,126 | 11/1966 | Piazza | 297/DIG. 4 X |
| 3,730,589 | 5/1973 | Lane | 297/284 X |
| 4,015,878 | 4/1977 | Perkins | 297/353 |
| 4,073,537 | 2/1978 | Hammersburg | 297/DIG. 4 X |
| 4,143,910 | 3/1979 | Geffers et al. | 297/301 |
| 4,500,136 | 2/1985 | Murphy et al. | 297/284 |

FOREIGN PATENT DOCUMENTS

| | | | |
|---|---|---|---|
| 2929428 | 1/1981 | Fed. Rep. of Germany | 297/301 |
| 12550 | of 1903 | United Kingdom | 297/284 |
| 2029334 | 3/1980 | United Kingdom | 297/DIG. 4 |

*Primary Examiner*—Kenneth J. Dorner
*Assistant Examiner*—Peter R. Brown
*Attorney, Agent, or Firm*—Chapin, Neal & Dempsey

[57] ABSTRACT

Invalid's chair has a support frame which includes a main support section, a seat support section pivotable on the main frame section and a back frame section, pivotable on the seat support section of the frame. The chair includes a seat cushion mounted on the seat frame and lower and upper back support cushions carried by the back frame and being independently adjustable relative one another. The seat and back frame sections are tiltable on the main frame together and the back frame is also tiltable independently of the seat frame. A tilting control cylinder is disposed between the back support section of the frame and the seat section and another tilt control cylinder is disposed between the seat section and the main support section to enable tilting of the back and seat portions of the chair together and independent tilting the back portion. The back support frame section and seat frame section are each pivotable about pins which are disposed substantially forward of the back edge of the seat cushion. The chair also includes body support pads disposed on the back support frame and each is disposed on a universal mounting fixture having three degrees of movement operable by a single knob. The seat cushion of the chair includes a contour control mechanism for selectively varying its contour. All of the control mechanisms and the operation of the component parts of the chair are disposed on the chair frame to be accessible from a position directly behind the chair.

6 Claims, 8 Drawing Figures

INVALID'S CHAIR CONSTRUCTION

BACKGROUND OF THE INVENTION

This invention relates to chairs of the type used for invalids and, more particularly, to an invalid's chair in which the backrest and seat portion are pivotable in such a manner as to be readily accomplished by the attendant with minimum force and with minimum displacement of the patient.

Wheelchairs have generally been designed as a means for moving nonambulatory patients from one location to another but, more recently, such conventional types of wheelchairs are being used more in nursing homes for accommodating the patients or elderly residents for extended periods of time. For this purpose, the conventional wheelchair is totally unsuitable from the standpoint of patient comfort and adequate body support.

In many cases, an elderly patient lacks the muscular control to remain seated in a chair without having his head or upper torso lean uncontrollably to one side or the other side of the chair. Moreover, each patient has highly individualized requirements in chair size, shape and support features required for maximum comfort for persons seated for lengthy continuous periods of time.

The prior art discloses many attempts to improve on conventional wheelchairs, such as U.S. Pat. Nos. 3,497,259; 3,640,571; 3,704,910; 4,073,537; 4,333,681 and 4,565,385. None of these patents, however, disclose an invalid's chair having all the advantageous features which contribute to the comfort and versatility of the chair embodying this invention.

The principal object of this invention is to provide an invalid's chair having novel constructional features not heretofore available.

Another object of this invention is to provide a chair of the above-type which is constructed to facilitate the tilting of the back support and seat portions thereof with minimum force by the attendant.

A further object of this invention is to provide a chair of the above-type in which body support members are universally adjustable with a single knob.

Yet another object of this invention is to provide a chair having separately adjustable lower and upper back support cushions.

Still another object of this invention is to provide a seat cushion having means by which its contour can be readily varied.

A still further object of this invention is to provide a chair in which the seat and back frame are each separately controlled by separate hydraulic control cylinders.

The above and other objects and advantages of this invention will be more readily apparent from the following description read in conjunction with the accompanying drawings in which:

DETAILED DESCRIPTION OF THE DRAWINGS:

FIG. 8 is an exploded perspective view showing the three sections which make up the supporting frame of the chair.

Figure 1:
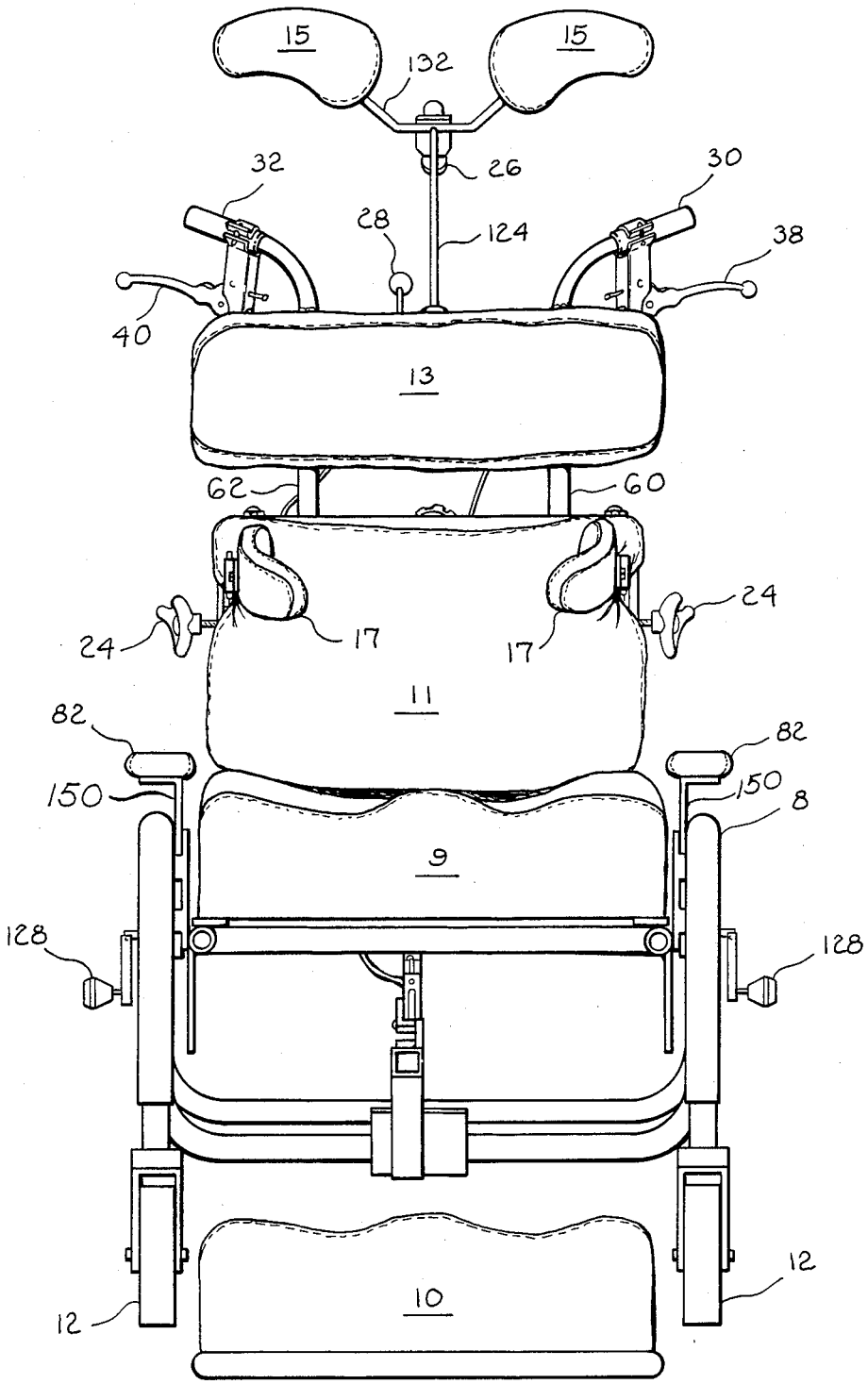
FIG. 1 is a front elevational view of an invalid's chair of the type embodying this invention.

Referring in detail to the drawings, in FIG. 1 is shown an invalid's chair which comprises a tubular metal frame, shown generally at 8, supported by four wheels 12. The frame, also illustrated in FIG. 8, comprises an outer or main support section 14, an intermediate, seat support section 16 pivotably mounted on the outer frame 14, lower back support section 18 pivotably supported by the intermediate frame and an upper back support frame 19 adjustable in height relative to the frame 18.

Figure 2:
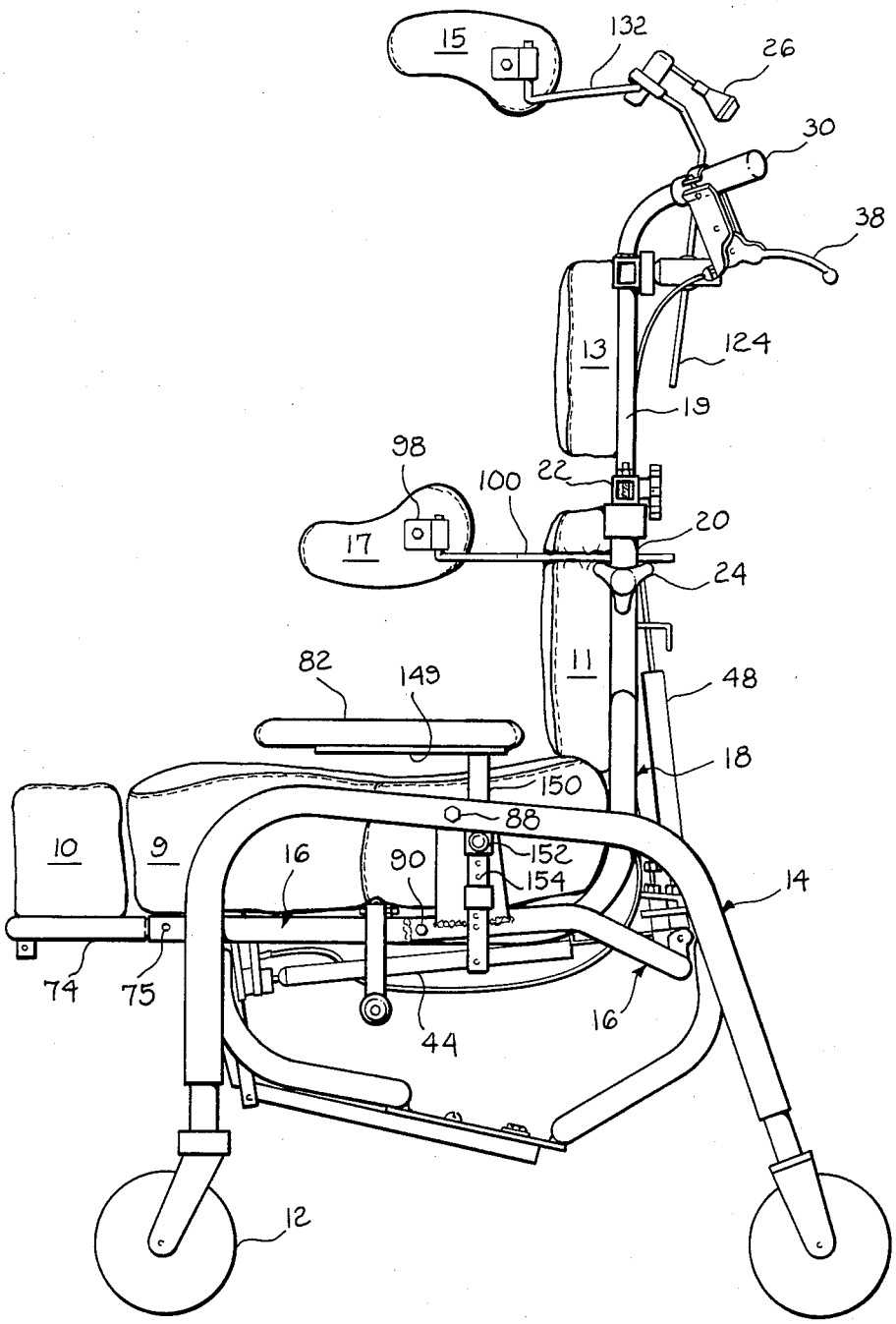
FIG. 2 is a side elevational view of the chair.

The chair includes a cushioned seat 9 with contour adjustment, a lower back support cushion 11 with adjustable lumbar support and an upper back support cushion 13 spaced from the lower back support cushion. The three cushions are respectively mounted on the seat section frame 16, lower back support frame 18 and a separable upper back support frame 19 of the chair. A separate, seat extension cushion 10 is also provided to be used to extend the depth of the seat, as depicted in FIG. 2, for the comfort of taller patients. In addition, the chair includes a pair of universally adjustable head support members 15 contoured to fit comfortably against opposite sides of the patient's head. Trunk or body support cushions 17 are also supported by universally adjustable mounting members 20 carried on a horizontal cross-bar portion 22 of the frame. A single knob 24, for each mounting member, facilitates the universal adjustment of the trunk support cushion, as will hereafter be more fully described.

Figure 3:
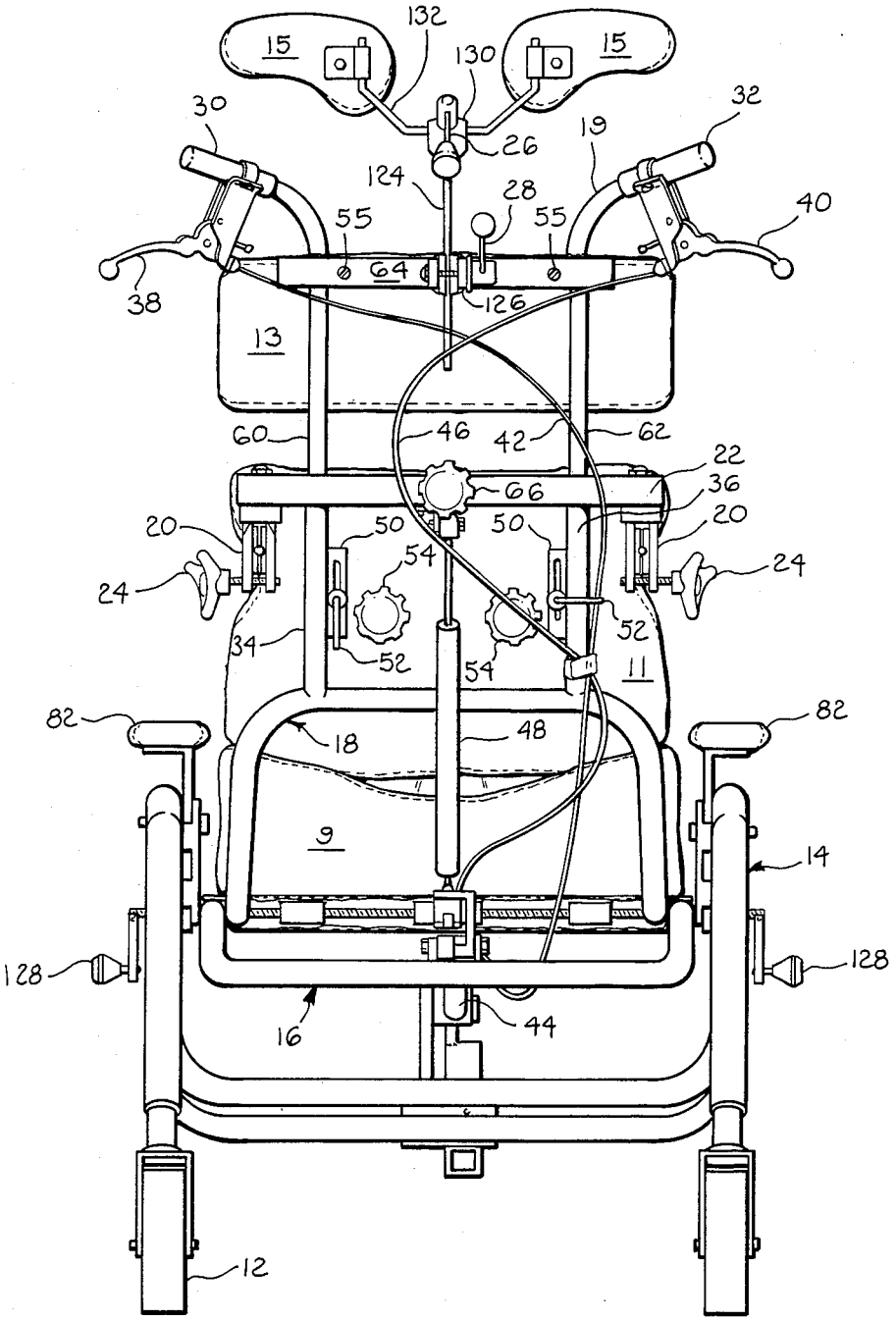
FIG. 3 is a rear elevational view of the chair.

As best illustrated in FIG. 3, operation of the chair and all its adjustment controls are readily accessible from a position behind the chair. For example, the head rests 15 are adjustable by means of levers 26 and 28, as will hereafter be more fully described. Handles 30 and 32 for moving the chair about on its wheels, extend upwardly and outwardly from two laterally spaced, vertical tubular posts 60 and 62 which are part of the upper chair frame 19, as will hereafter be more fully described.

Pivotable handgrips or calipers 38 and 40 are mounted on the handles 30 and 32 and serve to enable an attendant to control the angular position of the chair, including its seat and back cushions using handgrip 38. The back supportion portion of the chair can also be tilted separately by using caliper 40. The caliper 38 is connected by a sheathed flexible cable 42 to operate a valve which controls the operation of a combination gas, such as Nitrogen, and hydraulic cylinder 44, to enable tilting of the back and seat portions of the chair as a unit. The other caliper 40 is connected by cable 46 to control the valve of another gas and hydraulic cylinder 48 which serves to enable the back support portion of the chair to be slowly and smoothly tilted independently of the seat portion.

The lower back cushion 11 is mounted on posts 34 and 36 of the inner frame 18 by means of brackets or plates 50 affixed to opposed inner edge portions of the posts. A lever controlled screw-fitting 52 extend from the frame of the cushion 11 through an elongated slot in each plate 50 and are screw-fitted into a backing plate or panel (not shown) of cushion 11. An adjustable lumbar support mechanism, disposed within the cushion 11, may be adjusted by rotating one or both of the horizontally spaced knobs 54. Each knob 54 is adapted to vary one side portion of the cushion 11 in the lumbar region.

The upper back cushion 13 is affixed by fasteners 55 which extend through a horizontal cross-bar 64 secured onto the tubular posts 60 and 62 which make up the upper back support frame 19. The fasteners are screw-fitted into a backing panel (not shown) of the cushion. The handles 30 and 32 are located on the outwardly flared upper end portions of the posts 60 and 62. The posts 60 and 62 are tubular steel of slightly smaller diameter than posts 34 and 36 of lower frame 18 so that the former will telescopically fit into the upper ends of the frame 18. A knob 66, which is threaded into cross-bar 22, enables vertical height adjustment of cushion 13 relative to lower, back support cushion 11. The knob 66 operates a screw-fitting for releasably engaging the posts 60 and 62 to lock or release the posts 60 and 62 in the posts 34 and 36 of the frame 18. Thus, cushions 11 and 13 are each independently adjustable for maximum comfort of the individual patient no matter his or her body size.

Figure 4:
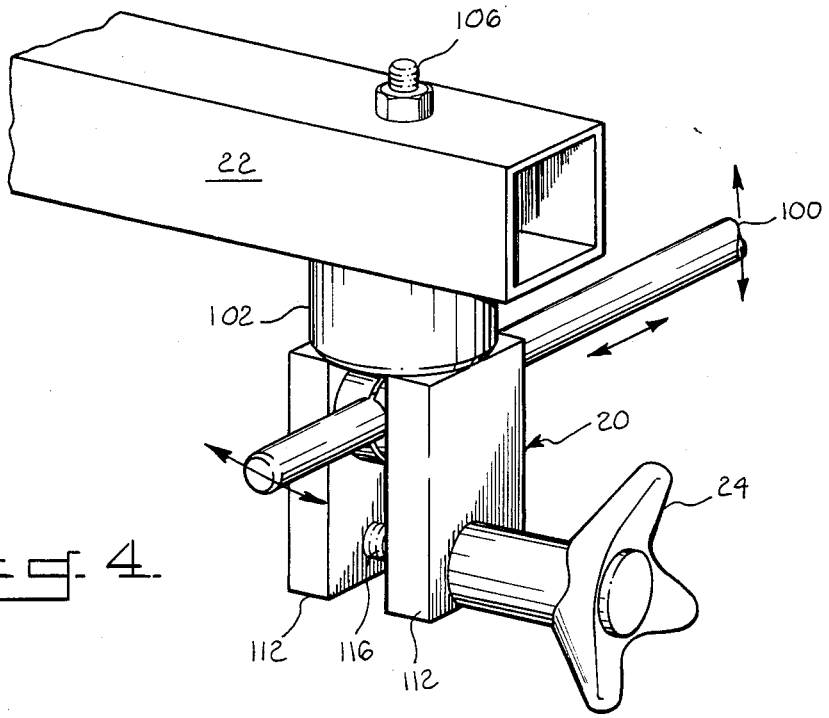
FIG. 4 is a perspective view depicting a pivotable mounting member for the trunk support portions of the chair.
Figure 5:
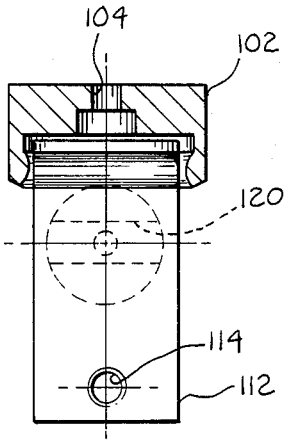
FIG. 5 is a side elevational view, partly in cross-section of the mounting member of FIG. 4.
Figure 6:
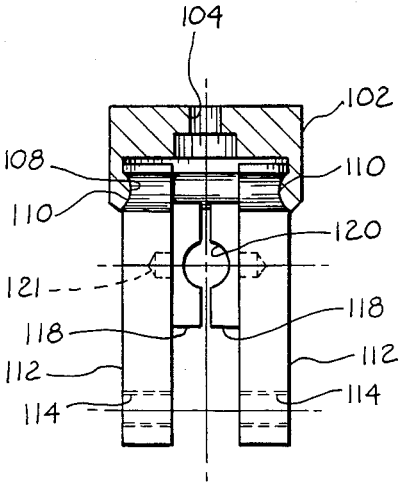
FIG. 6 is an end elevational view of the mounting member.

The construction and operation of the chair frame 8 will best be understood by reference to FIGS. 4 and 8 of the drawings. The frame comprises three separate sections pivotably interconnected at points located below the center of gravity of a patient seated normally on cushion 9 with his lower back resting against cushion 11. The main frame 14 includes a pair of inverted, generally U-shaped, tubular leg members 66 and 68 having generally horizontal upper limbs and diverging leg portions into which the wheels 12 are fitted. A pair of tubular cross braces 70 and 72 extend from corresponding points of the two leg members 66 and 68. A longitudinally extending brace 74 is disposed approximately at the midpoint of the two cross braces and also serves as a mounting bracket for mounting one end of the cylinder 44.

Figure 7:
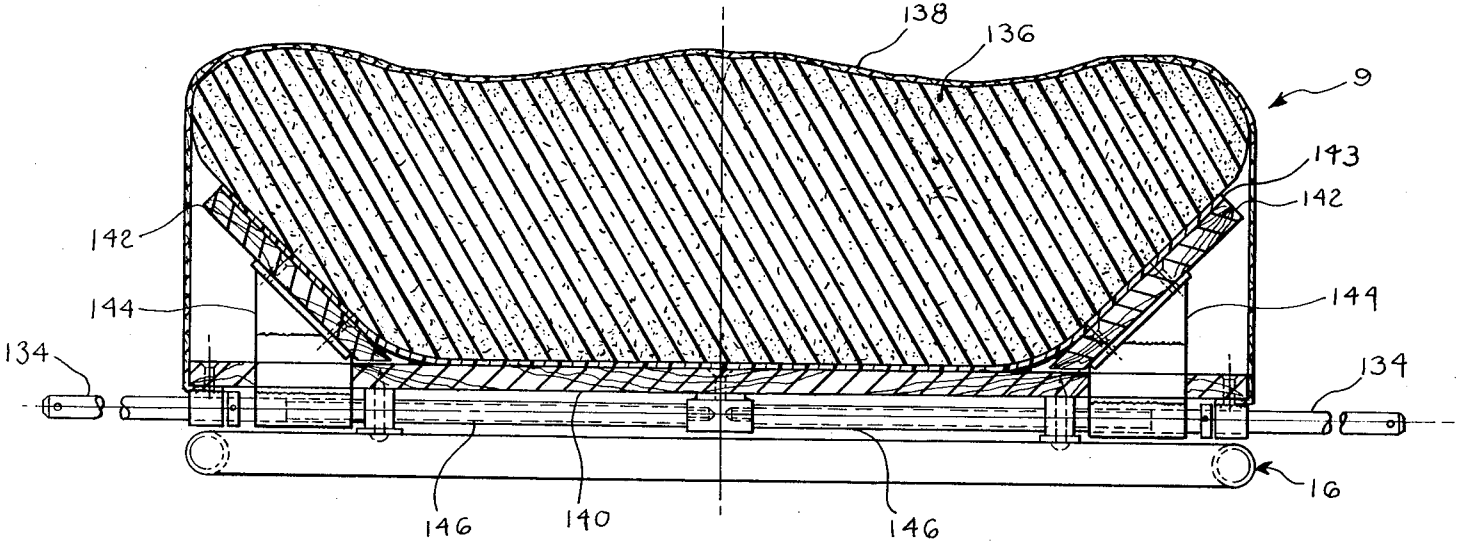
FIG. 7 is an elevational view of the seat portion of the chair partly in cross-section to illustrate a contour adjusting mechanism.
Figure 6:
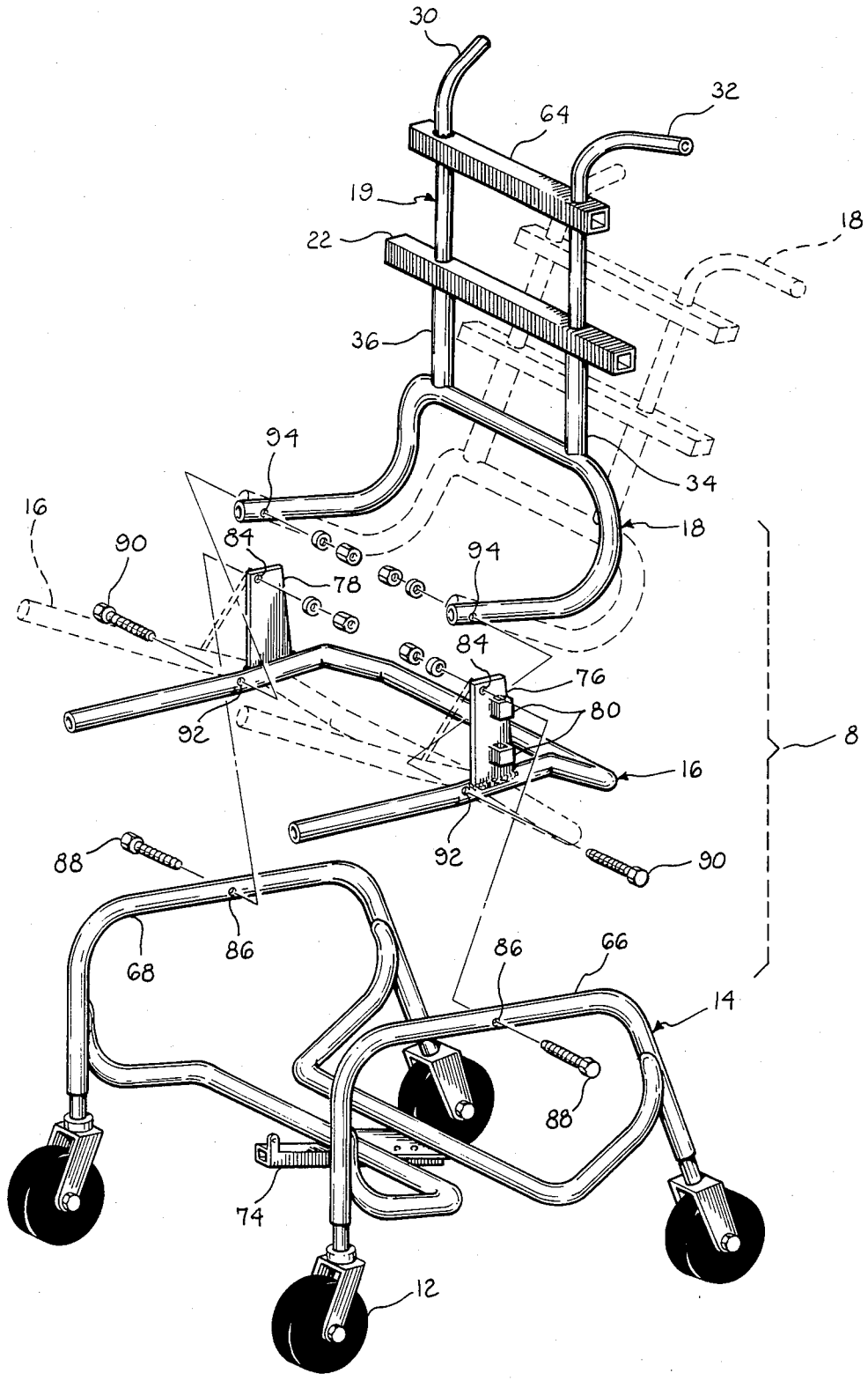

The seat cushion 9 (see also FIG. 7) is affixed to the upper surface of the seat support frame 16. As best illustrated in FIG. 8, the seat frame is of generally U-shaped configuration with its open end disposed forwardly for optionally receiving a small tubular frame 74 (FIG. 2) of the seat extension cushion 10. Spring pins 75 are provided to releasably retain the frame 74 in assembled relation on seat frame 16. The frame 16 includes a downwardly angled, oblique rear portion to provide clearance for ease of assembly of cylinder 44, with its piston rod being connected to frame 16 and the cylinder to bracket 74.

A pair of upstanding side plates or brackets 76 and 78 are welded to corresponding locations on the upper limb portions of the frame 16. Plates 76 and 78 serve two separate functions: first, they provide the mounting means for the seat section 16 of the frame on the main support frame 14, substantially below its pivotable mounting point. Secondly, each plate includes a pair of U-shaped mounting brackets 80 which provides channels for the vertical adjustment of the chair arms 82, as will hereafter be more fully described. A hole 84 is provided through each plate 78 adjacent the upper forward edge thereof and a hole 86 of corresponding diameter is drilled through the upper limb portion of the main frame 14 at approximately the midpoint thereof. A bolt or pivot pin 88, pivotably interconnects the seat frame section 16 to the main frame 14. The seat frame 16 thus depends from pivot pins 88 well below the upper limbs 66 and 68 of the frame 14.

The inner or back frame section 18 is pivotably connected adjacent its lower end by pivot pins 90 which extend through holes 92 in frame 16 and corresponding holes 94 in the legs of the frame 18 adjacent the outer ends thereof. The seat frame 16 is thus pivotable on the main frame about pins 88 and is disposed between the other two sections. The back or inner frame section 18 is pivotably supported by the seat frame 16 about the pins 90. Pivot pins 90 are disposed substantially below and slightly forward of pins 88 but at points located about six (6) inches forward of the rear edge of seat cushion 9. The gas and hydraulic cylinder 44, having one end connected to bracket 74 and its piston rod connected to the rear cross-bar portion of the frame 16, is adapted to control the tilting of the frame 16 and, with it, frame 18 since the latter is carried by the former. The other cylinder 48 is connected at one end to frame 16 and its piston rod is connected to the frame 18 at its cross-bar 22, whereby the back support frame may be tilted relative to the seat frame 16. The dotted line representations of frame sections 16 and 18, in FIG. 8, illustrate two of an infinite variety of positions to which the seat frame and the back frame may be tilted. Significantly, the attendant standing behind the chair and using caliper 40, may tilt the seat cushion 9 and the back cushions as a unit or, if is is desired, using caliper 38, may tilt just the lower and upper back support cushions of the chair without tilting the seat cushion itself.

The pins 88 about which the seat 9 and its frame 16 are pivotably supported are each disposed at about the midpoint of the horizontal portion of U-shaped members 66 and 68. Moreover, these pivot pins are located about one-third the depth of seat cushion 9 measured from the inner or back edge of the seat. Similarly, pivot pins 90, about which the back frame is pivotable, are each located under the seat and slightly forward of the mounting position of pivot pins 88. With this arrangement, the chair back can be tilted about a location in line with the hip joint of a normally seated patient, whereby the patient's torso and the chair back will, in essence, be tilted together. This means that it will not be necessary to readjust the positions of the head and trunk support members 15 and 17 each time the back of the chair is inclined or raised.

An important feature of this invention is that the chair is constructed with its pivot points located so that when the seat and back support cushions are inclined together, the center of gravity of a patient sitting normally on the cushion 9 and with his back against cushions 11 and 13, will be shifted or carried forwardly to counterbalance the increased weight component being supported by the back of the chair as it is tilted downwardly. As a result, very little strength is required to control the tilting of the chair and an attendant of slight stature will have no difficulty accomplishing this task, even with a very large patient seated in the chair.

FIGS. 3–7 illustrate the universally adjustable mounting means of the body or trunk supports 17. Each trunk support comprises a generally kidney-shaped pad disposed about a backing plate (not shown). A bracket 98 is disposed on the outer surface of each pad. The bracket includes a cylindrical bore adapted to receive the upstanding leg portion of an L-shaped mounting rod 100. Each pad can be inverted, for increased patient comfort, by simply lifting, inverting and fitting the opposite end of the bore onto the upstanding leg of rod 100. The concave curvature of the pads can thus be oriented upwardly, as shown in FIG. 2, or downwardly, if desired.

Each rod 100 is slidably received by universal mounting fixture 20, as best illustrated in FIG. 4. The fixture 20 is mounted by a bolt or stud 106 adjacent the outer ends of cross-bar 22 of the rectangular tubular stock. The mounting fixture 20 comprises, at its upper end, a cylindrical support sleeve 102 which has a central hole 104 adapted to receive the mounting stud or bolt 106. The lower inner edge portion of sleeve member 104 is provided with an annular bushing comprising a groove and annular bear 108 of convex curvature which is rotatably coupled to annular, concave grooves 110 formed within the outer, upper peripheral end portions of a pair of depending mounting plates 112. Adjacent the lower end of each plate is a threaded hole 114 to receive a clamping screw 116 (FIG. 4) which may be rotated by handle 24 to loosen or tighten the grip of the fixture on the rod 100.

The inner surface of each plate 112 is provided with a disc 118 mounted on each plate 112 and rotatable in a vertical plane parallel to the plate 112. A small pin 121 extends outwardly from the center of each disc 118 and rotatably fits into a hole in each plate 112. The opposed inner surface portions of each rotatable disc includes a semi-cylindrical, horizontally extending groove 120 adapted to slidably receive and hold the rod 100 in surface-to-surface engagement. The grooves 120 are disposed intermediate the annular grooves 110 and clamping screw 116 so that rod 100 serves as a fulcrum between the lower and upper end portions of plates 112. With this construction, when the handle 24 is rotated clockwise to tighten the disc 118 about the circumference to rod 100, the upper ends of the plates 112 will be deflected outwardly by this lever action so as to be clamped securely within the annular channel 108 formed in sleeve 102. Simultaneously, the rotatable discs 118 are clamped between the abutting inner surfaces of plates 112 and frictionally held in a fixed position. On the other hand, when the screw 116 is rotated counterclockwise to loosen the fitting, the rods 100 are each free to move about three degrees of freedom, as illustrated by the arrows in FIG. 4, i.e., slide in and out, pivot up and down and rotate side-to-side.

The headrest pads 15 are of generally the same construction as pads 17 and, although each is also movable about three degrees of freedom, they are mounted in a different manner. Both pads 15 are supported on a single, rotatable and vertically adjustable rod 124. The rod is also mounted in clamping fixture 126 for pivotable movement angularly in a vertical plane. The fixture 126 may be similar to the clamping plate and rotatable disc construction of FIG. 4. Thus, by loosening the clamping fixture, using lever 28, the rod 124 may be adjusted to the desired height and tilted in any suitable angle and locked in any such preselected position. At the outer end of rod 124 is a second clamping fixture 130, adapted to clamp and release generally U-shaped mounting rod 132 which supports the two head support pads 15. These pads may be readily inverted in the same manner as the trunk pads 17.

Since many nursing home patients spend many hours seated in wheelchairs, it is very important that the chair be adapted to the body contour of the individual patient. Since most of the patient's weight is supported by the seat, it is essential that the seat cushion be capable of accommodating the patient's individual requirements. In this connection, the chair embodying this invention includes means for actually varying the contour of the seat cushion 9. For this purpose, the chair includes a hand crank 128 disposed on each side of the chair. Each of the hand cranks is connected to rotate a drive shaft 134 (FIG. 7) mounted between the seat frame 16 and the bottom of the cushion 9. The cushion includes an elastomeric foam filler 136 which may be contoured, as shown. The cushion is enclosed within an outer covering 138 material, such as leather or a synthetic substitute. The underside of the cushion 136 is disposed on a base 140, such as a plywood sheet and the lower side edge surfaces of the foam 136 are supported by diagonally disposed support members 142, which may also be fabricated of plywood or the like. The outer surfaces of the support members 142 are disposed on the obliquely angled upper surfaces of screw-driven carriers 144. The carriers each include a threaded lower end portion meshed with the threaded periphery of a drive-screw 146 suitably coupled to the inner ends of drive shafts 134. A plastic sheet 143 is disposed between the upper surface of the plywood base 140 and oblique support members 142 so that the support members can slide readily relative to the cushion 136.

As each hand crank 128 is rotated, the screw 146 is caused to rotate and thereby advance each of the carriers inwardly or outwardly depending upon the direction of rotation of the hand cranks. This movement translates into deformation of each side of the contour of the cushon foam 136 whereby its contour can be varied on one or both sides, as desired for the individual patient.

Each arm 82 of the chair includes a horizontal cushioned portion supported on a horizontal bar 149 (FIG. 2). A vertical bar 150 extends from the underside of the arm adjacent the rear edge thereof. The bar 150 is adapted to slidably fit into the vertical channels formed by brackets 80 on the outer surface of mounting plates 76 and 78 (FIG. 8). A spring pin 152 is adapted to fit into any one of a series of holes 154 which are provided in vertically spaced relation through bar 150. In this way, the chair arm 82 can be adjusted to the desired height for each individual patient. In addition, the mounting bar 150 depends from adjacent the inner edge of each arm 82, as depicted in FIG. 1, and the arms are fully interchangeable from one side to the other of the chair. In this way, the spacing between the arms can be changed for slimmer patients by simply interchanging the arms from FIG. 1 positions which would accommodate heavier patents.

Having thus described my invention, what is claimed is:

1. Invalid's chair comprising a wheel supported frame including a pivotable seat support section and a pivotable back support section, the seat support section having a seat cushion disposed thereon, said cushion having outer, inner and side edge portions, said seat support section and back support section being tiltable about discrete pivot means disposed at a distance from the inner edge of the seat cushion of about one-third of the depth of said seat cushion measured from its inner to outer edge so that a patient's torso and chair back will essentially be tilted together, a pair of rod supported, trunk engaging support pads disposed on the back section of said frame by mounting means whereby the trunk pads remain in essentially fixed relation to the patient's torso when tilted with said chair back, said mounting means being horizontally rotatable and vertically pivotable and also linearly adjustable, said mounting means each including a means for clamping said rod in fixed position and simultaneously locking the rod in a fixed horizontal and vertical angular positions.

2. Invalid's chair as set forth in claim 1, in which said seat cushion includes an elastomeric foam filler material having a predetermined contour which includes inwardly inclined side-edge portions, said foam being at least partially enclosed within a flexible covering material, the side-edge portions of said filler being supported by a pair of diagonally disposed, horizontally movable oppositely inclined support members, drive means engaged with each of said diagonal support members for rectilinearly moving the same toward and away from each other to vary selectively the contour of said seat cushion.

3. Invalid's chair as set forth in claim 1, in which the mounting means for the trunk support pads comprises a base with an annular bead of spherical cross-section rotatably receiving thereon a spherical, annular groove formed on the outer, upper end portion of each of a pair of laterally-spaced, depending mounting plates, the lower ends of said plates including a fastener means for urging the lower ends of the plates toward each other, the opposed inner surfaces of each of said plates each being provided with a disc rotatable about an axis normal to the plate, opposed inner surface portions of each disc includes a semi-cylindrical groove which together define a rotatable bore adapted to slidably receive and hold the rod on which said trunk pads are mounted whereby the trunk pads may be rotated horizontally and vertically and adjusted linearly by said mounting means.

4. Invalid's chair as set forth in claim 1, in which a first gas and hydraulic cylinder extends between a point on the wheel supported frame and a point on the seat support section of the frame to control the tilting of the seat support section and a second gas and hydraulic cylinder interconnecting the seat support section of the frame and the back support section of the frame for pneumatically and hydraulically controlling the tilting of the seat frame section and the back frame section and means for actuating each of said cylinders.

5. Invalid's chair as set forth in claim 4, in which a pair of calipers are affixed to said frame with a control cable extending from each of said calipers to each of said hydraulic cylinders for separately actuating each of said cylinders.

6. Invalid's chair as set forth in claim 1, in which said back support frame section includes lower and upper portions extensibly interconnected, a lower back support cushion disposed on the lower portion of the back frame and an upper support cushion disposed on the upper portion of the back frame, means for adjustably interconnecting the lower back cushion to the lower portion of the back frame section for vertical movement thereon whereby the lower and upper back support cushions are independently, vertically adjustable.

* * * * *